US006305098B1

(12) United States Patent
Guglielmero

(10) Patent No.: US 6,305,098 B1
(45) Date of Patent: Oct. 23, 2001

(54) ROTARY PRINTING PRESS DRYING ASSEMBLY ROLLER

(75) Inventor: Enrico Guglielmero, Gariano-Rosignano (IT)

(73) Assignee: Officine Meccaniche Giovanni Cerutti S.p.A., Casale Monferrato (IT)

( * ) Notice: Subject to any disclaimer, the term of this patent is extended or adjusted under 35 U.S.C. 154(b) by 0 days.

(21) Appl. No.: 09/771,810

(22) Filed: Jan. 29, 2001

(51) Int. Cl.[7] ..... F26B 25/00
(52) U.S. Cl. ..... 34/104; 101/228; 101/327
(58) Field of Search ..... 34/104, 114, 115, 34/117, 119, 124, 47, 457; 425/3; 101/327, 232, 425, 147, 228, 181, 148, 389.1; 226/190; 346/74.5

(56) References Cited

U.S. PATENT DOCUMENTS 3,556,005 * 1/1971 Koch ..... 101/147
4,116,594 * 9/1978 Leanna et al. ..... 425/3
4,502,228 * 3/1985 Helbig et al. ..... 34/47
4,781,116 * 11/1988 Harada ..... 101/425
5,188,273 * 2/1993 Schmock ..... 226/190
5,415,094 * 5/1995 Morrone ..... 101/327
5,421,259 * 6/1995 Shiba et al. ..... 101/232
5,483,887 * 1/1996 Grosshauser ..... 101/181
5,795,323 * 8/1998 Beck ..... 101/389.1
5,978,001 * 11/1999 Furlani et al. ..... 346/74.5
6,082,258 * 7/2000 Harrington ..... 101/148
6,116,159 * 9/2000 Koyama ..... 101/228
6,145,218 * 11/2000 Kotitschke et al. ..... 34/457

FOREIGN PATENT DOCUMENTS

4401378 * 6/1994 (DE) ..... D21F/5/14

* cited by examiner

*Primary Examiner*—Teresa Walberg
*Assistant Examiner*—Leonid Fastovsky
(74) *Attorney, Agent, or Firm*—Kirschstein et al.

(57) ABSTRACT

A roller for a rotary printing press drying assembly, comprising, near each printing unit, a drying assembly including a plurality of parallel rollers, each roller being circumferentially provided with a plurality of equispaced slots which are arranged parallel to the longitudinal axis of the cylinder.

5 Claims, 3 Drawing Sheets

ROTARY PRINTING PRESS DRYING ASSEMBLY ROLLER

BACKGROUND OF THE INVENTION

The present invention relates to a roller for a rotary printing press drying assembly.

As is known, e.g. in printing paper material bands, a plurality of printing units including known ink applying devices are generally used.

Said printing units comprise drying assemblies, including a plurality of parallel rollers which, immediately after the printing cylinder of the printing unit, extend upward, and then downward, to convey the paper band toward a following printing unit.

The above mentioned drying assemblies operate to remove from the paper band the solvents of the just applied ink, while simultaneously drying said ink.

Since the bands to be printed, generally made of a paper material, are greatly hygroscopic, they, upon contacting the printing cylinder, absorb a comparatively great amount of ink and solvent particles, thereby causing the paper band to greatly expand.

Moreover, since the paper band is mainly stressed, as it is conveyed, by a pulling force, the longitudinal expansions are integrally compensated for, whereas the cross expansions of the paper band cannot be compensated for and, accordingly, as the paper band passes through the series of parallel rollers of the ventilating assembly, a plurality of comparatively narrow creases extending in the band feeding direction are formed.

In a finished product, said creases would constitute a waste generating defect, with a consequent yield decrease.

SUMMARY OF THE INVENTION

Accordingly, the object of the present invention is to overcome the prior art drawbacks, and provide a particular type of roller, to be used in a drying assembly, which allows to safely prevent longitudinal creases from being formed within a printed paper band.

According to the invention, the above object is achieved by a roller to be arranged in a roller series in a drying assembly, said roller being circumferentially provided with a plurality of equispaced slots which are arranged parallel to the longitudinal axis of the roller and are delimited by projecting ribs.

Thus, about the circumference of each roller a plurality of slots allowing the movable band, partially contacting longitudinal ridges delimiting a related slot, to be extended in a cross direction, thereby eliminating possible paper creases, and allowing the paper band to extend in the width direction thereof are defined.

Advantageously, the valleys and ridges define circle sectors, each of which encompasses an angle of approximatively 15° to 35°.

Moreover, the slots and ridges are formed with an arch length of about 30 mm.

Owing to the interruption of the continuous circumference of each roller, by providing valleys in the form of broad slots alternating with ridges or ribs, the paper band can be moved and extended in the width direction thereof as it passes through the free space formed by said slots, thereby preventing or compensating for any permanent formations of undesired creases in the printed band.

BRIEF DESCRIPTION OF THE DRAWINGS

The subject matter of the present invention will be disclosed and illustrated in a more detailed manner hereinafter with reference to an embodiment thereof given exclusively by way of an example in the accompanying drawings, where.

DESCRIPTION OF THE PREFERRED EMBODIMENTS

Figure 1:
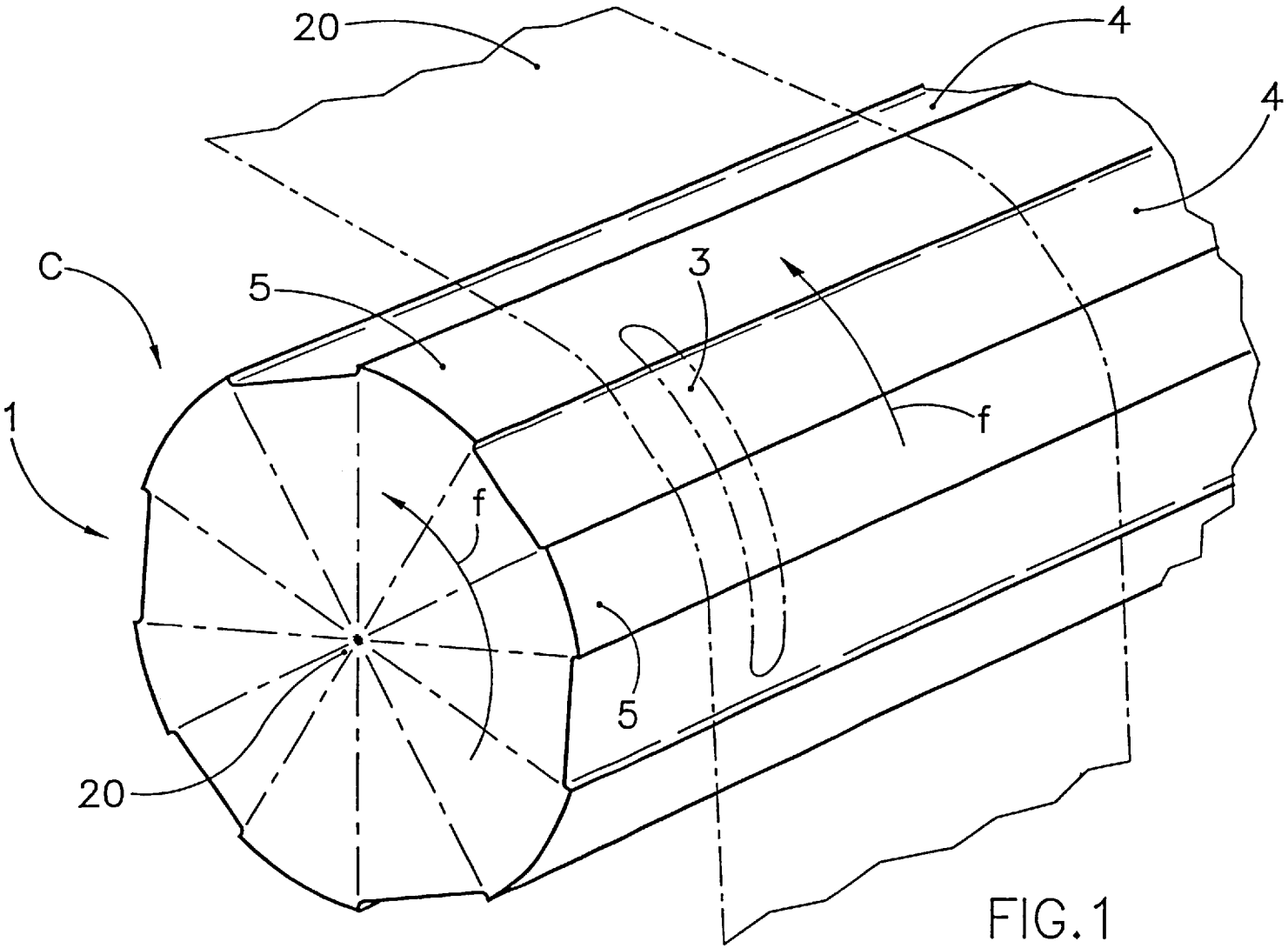
FIG. 1 is a schematic perspective view illustrating a portion of one of the rollers to be included in a drying assembly therethrough a paper band is conveyed.

As is known, the drying assemblies arranged near each printing unit, for example in a rotary printing press, comprise a plurality of parallel rotary rollers. A detail of a roller is shown in FIG. 1 and generally indicated by 1.

The rotary rollers 1 operate to support and convey the just printed paper band 2, which is driven at a comparatively high speed in the direction indicated by the arrow f.

The ventilating or drying assemblies are usually provided with rollers having a fully smooth circumference and, accordingly, as the band 2 is conveyed through a said drying assembly, undesired longitudinally extending creases and wrinkles are formed therein.

More specifically, said creases are formed in said band since the paper band 2 being pulled cannot be extended in its width direction.

Figure 3:
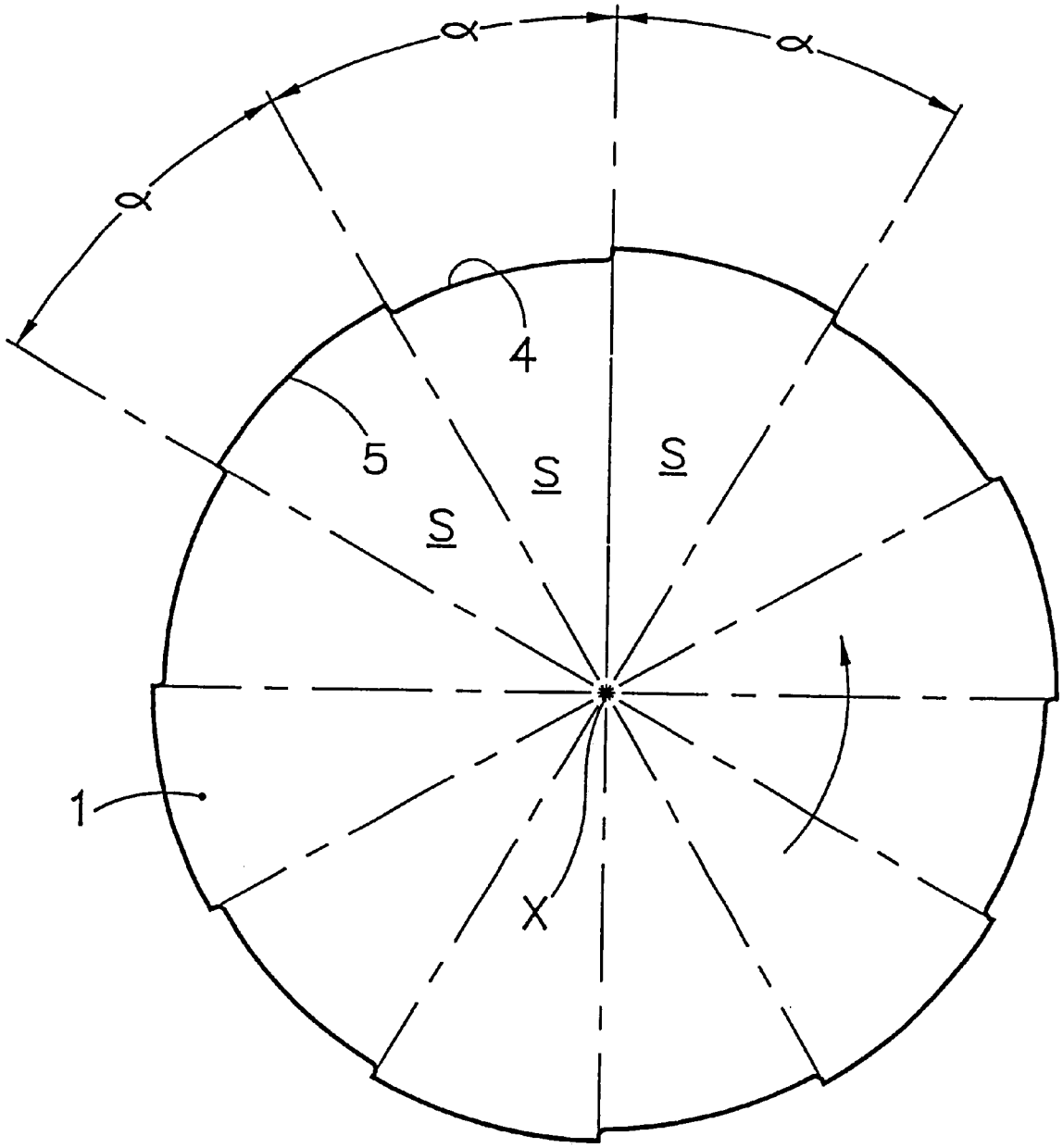
FIG. 3 is a front view of the roller being divided in even circle sectors ending at top or edge a portions, respectively at valley portions.

One of the above mentioned creases 3 is indicated, by way of an example, by a dash and dot line in FIG. 3.

The invention proposes now to interrupt the closed circumference of a prior roller used in prior ventilating assemblies, by forming slots equispaced from one another and extending parallel to the longitudinal axis of the roller 1, and alternating a slot 4 forming a recessed zone with a projection or ridge defining a rib 5. Thus, the slots 4 and ribs 5 extend parallel with to the roller 1 axis X and about the circumference of said roller.

Figure 2:
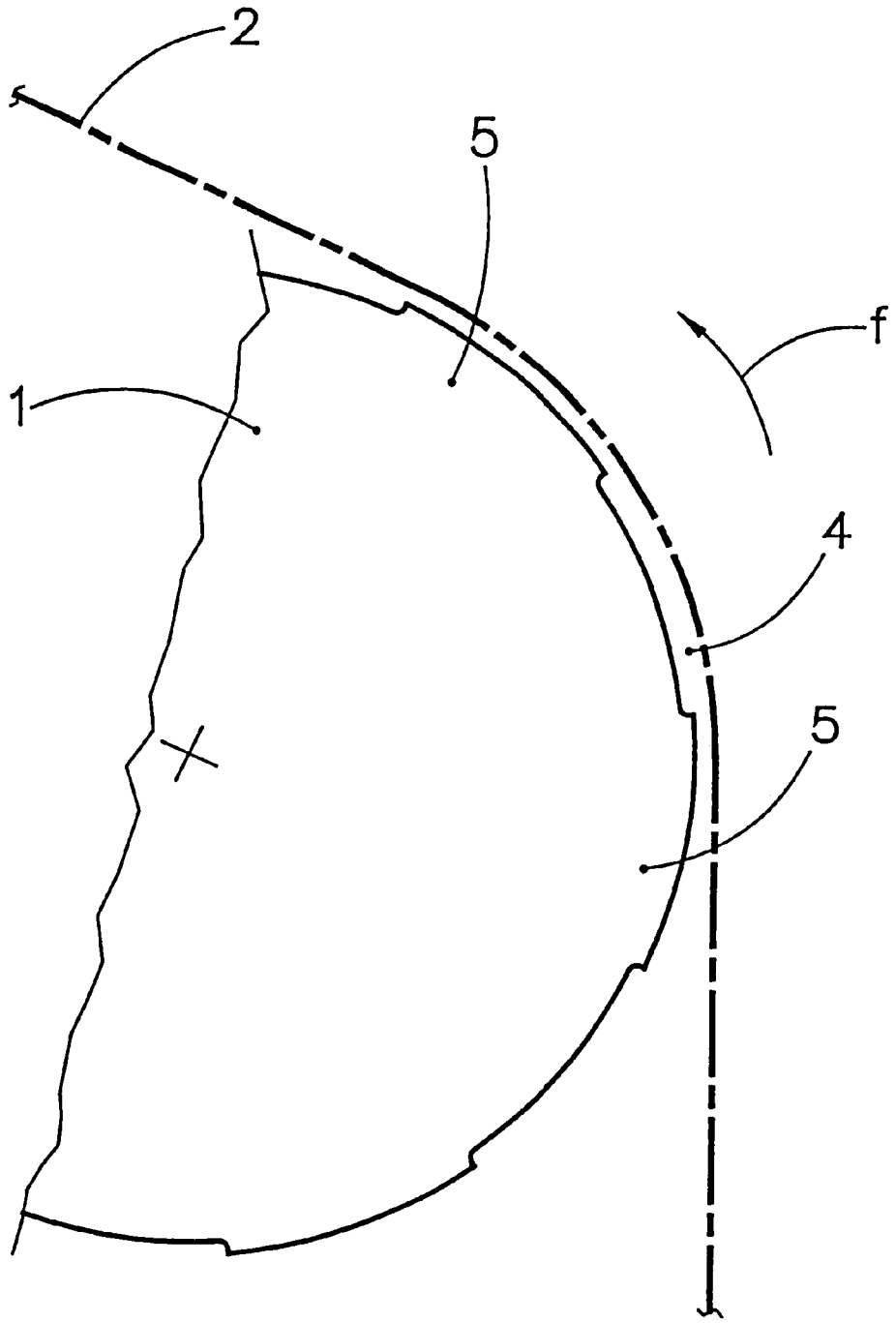
FIG. 2 is a front view illustrating the roller shown in FIG. 1.

FIG. 2, which is a front view of the cylinder or roller 1, shows that the paper band 2 bears, as it is driven in the direction of the arrow f, only and exclusively on the ribs 5 of the cylinder 1. Thus, the paper band 2 is not hindered, and is suspended without bearing as it passes, on the rotary roller 1, through the free space defined by a slot 4.

Accordingly, the paper band 2 will alternatively abut on a projecting rib 5, but it will be free of moving in a cross direction in passing through the roller 1 zone defined by the slot 4.

As shown in FIG. 3, the projecting ribs are evenly alternated with corresponding slots 4.

From the cylinder 1 axis X a plurality of imaginary circle sectors, schematically indicated by S, extend, said sectors S ending at the ribs 5, respectively the slots 4, and advantageously defining an angle a of approximatively 15° to 35°.

The angle a would be selected depending on the diameter of the cylinder or roller 1, the depth of the slots 4 also depending on said roller diameter. It is important to assure that the "non contacting" zone of the paper band 2 and roller 1 be such as to allow the paper 2 to be distended.

Accordingly, the precise value of the angle a and, consequently, the size of the arch defining the ribs 5, respectively the slots 4, depends on the printing speed, the paper weight as well as the physic characteristics of the paper material forming said band 2; accordingly, the angle $\alpha$ can be changed depending on technical requirements.

Actually performed tests have demonstrated that it would be advantageous to provide the ventilating assembly roller 1 with 6–10 projecting ribs alternating with six recessed slots, i.e. recessed with respect to the roller 1 circumference.

As the paper band moves away from the printing assembly, the distance of the drying roller 1 will increase.

What is claimed is:

1. A roller (1) for a rotary printing press ventilating assembly, said ventilating assembly being arranged near a printing unit and including a plurality of parallel rollers, characterized in that said roller (1) is circumferentially provided with a plurality of slots (4) evenly spaced from one another and parallel to the longitudinal axis of said roller and delimited by projecting ribs (5).

2. A roller, according to claim 1, characterized in that said slots (4) or ribs (5) define circle sectors (S) encompassing an angle ($\alpha$) of approximatively 15°–35°.

3. A roller, according to claim 1, characterized in that said slots (4) or ribs (5) have an arch width of approximatively 30 mm.

4. A roller, according to claim 1, characterized in that said slots (4) have a depth of 1 to 4 mm.

5. A roller, according to claim 1, characterized in that the spacing of said rollers (1) increases in a direction away from a printing assembly.

* * * * *